United States Patent [19]

Simensen et al.

[11] Patent Number: 4,743,141

[45] Date of Patent: May 10, 1988

[54] OFFSHORE TRUSS WORK TYPE TOWER STRUCTURE

[75] Inventors: Per A. Simensen, Loevenstad; Gunnar H. Eide, Sandvika, both of Norway

[73] Assignee: Saga Petroleum A.S., Norway

[21] Appl. No.: 878,979

[22] PCT Filed: Sep. 18, 1985

[86] PCT No.: PCT/NO85/00057

§ 371 Date: Jul. 18, 1986

§ 102(e) Date: Jul. 18, 1986

[87] PCT Pub. No.: WO86/01845

PCT Pub. Date: Mar. 27, 1986

[30] Foreign Application Priority Data

Sep. 19, 1984 [NO] Norway ..... 843746

[51] Int. Cl.[4] ..... E02B 17/00

[52] U.S. Cl. ..... 405/195; 52/648; 405/204; 405/224

[58] Field of Search ..... 405/195–198, 405/203–210, 224; 52/236.1, 638, 648, 650, 693, 694; 114/264, 265; 182/178; 248/235; 29/428, 429, 469

[56] References Cited

U.S. PATENT DOCUMENTS

| | | | |
|---|---|---|---|
| 2,597,110 | 5/1952 | Lacy | 405/204 |
| 3,094,847 | 6/1963 | Pogonowski | 405/204 |
| 3,372,518 | 3/1968 | Rensch | 52/236.1 X |
| 3,563,580 | 2/1971 | Black | 52/648 X |
| 3,656,269 | 4/1972 | Witschel et al. | 52/638 |
| 4,018,057 | 4/1977 | Erzen et al. | 405/205 X |
| 4,106,302 | 8/1978 | Vogel | 405/204 X |
| 4,470,723 | 9/1984 | Michel et al. | 405/202 |

FOREIGN PATENT DOCUMENTS

| | | | |
|---|---|---|---|
| 2116615 | 9/1983 | United Kingdom | 405/205 |

*Primary Examiner*—Dennis L. Taylor

*Attorney, Agent, or Firm*—Scully, Scott, Murphy & Presser

[57] ABSTRACT

Method of constructing an offshore truss work type tower structure, and a tower structure comprising outer legs and leg connecting trusses, where all legs being parallel, trusses between outer legs and trusses arranged inwardly from outer legs, being diagonally arranged, one or more internal leg or legs being arranged in equidistant adjacent outer legs, all trusses from and between outer legs being arranged diagonally and secured to the legs by welding to forged nodal points whereby each nodal point on an outer leg being arranged at a level intermediate two nodal point levels on adjacent legs.

7 Claims, 4 Drawing Sheets

OFFSHORE TRUSS WORK TYPE TOWER STRUCTURE

FIELD OF THE INVENTION

This invention is related to an offshore truss work type tower structure comprising outer legs and an internal leg arranged in a hexagonal shape with the internal leg equidistant from the outer legs, and leg connecting trusses, and a method for construction of such structure.

SUMMARY OF THE INVENTION

Tower structures of the truss work type which typically are used as offshore platforms are traditionally constructed with vertically inclined legs, having decreasing cross section area towards the top of the tower. This type of design provides a good stability in operational position, however, due to the conical shape, creates certain problems in constructing as well as in launching the structure. Furthermore, the conical tower has some limitations when used in waters with increasing depths. Due to gas and oil exploration at increasing depths, other platform designs have to be taken into consideration and for the fixed platform type, the conically shaped tower is unsuitable.

With the tower structure according to this invention, several problems related to both connecting tower sections and launching these sections are avoided as the tower cross section substantially is the same along the entire tower height; the shape of the tower being prismatic. The advantages of the tower structure according to the present invention will be understood by the features stated in the characterizing clauses of the claims.

By design, a tower structure having a prismatic shape allows for trusses or bracings to be arranged in the outer panels, thereby resulting in a hollow type tower. This, however, would result in a large number of crossing trusses in the panels, which would mean a large number of nodal points.

By providing an internal or center leg, as in the present invention, the necessity of having crossing trusses in the outer panels is avoided.

Furthermore, the prismatic shape of the tower brings the advantage of a large number of uniform nodal points in a minimum number of nodal point types.

By designing the simplest form of the tower structure according to this invention, a prismatic tower structure having a uniform hexagonal cross section with one center leg is provided. In a single hexagon tower structure, a nodal point in an outer leg will have six truss connections, two trusses to each of the adjacent legs and two trusses to the center leg, all trusses thereby being arranged diagonally. At each nodal point level on the center leg, there also will be six truss connections. Such a hexagonal tower structure therefore will have two nodal point types.

In a tower structure having two partly overlapping hexagons, defined as a double hexagon, six of the outer legs also will have six truss connections at every nodal point level, whereas the two outer midlegs will have eight truss connections. In the double hexagon type tower structure, there are provided two internal legs which are connected with horizontal trusses perpendicular to these legs. The internal legs will have two different nodal points, one having seven truss connections and one having five truss connections, where one truss is arranged horizontally and perpendicular to the leg, and the rest are arranged diagonally. The double hexagon type therefore principally will have four different nodal point types.

The double hexagon tower structure type provides remarkably increased strength due to the addition of three outer legs, both in a direction perpendicular to the connection between the internal legs and substantially in this direction.

By the addition of two more outer legs, a triple hexagon tower structure can be achieved which increases the tower strength remarkably in all directions. In the triple hexagon tower structure type the amount of truss connections in the nodal points within the six outer legs and the three outer midlegs are six and eight, respectively, whereas all nodal points of the internal points will have five truss connections between the three internal legs will be arranged horizontally and perpendicular to the legs. Therefore, there will be only three nodal point types in the triple hexagon tower.

By using few nodal point types, although a large number of each type, the principal of forged nodal points advantageously can be used. Principally the truss length in the outer panels is the same, as well as in the radial and center panels, and each weld is made substantially as a butt weld which advantageously simplifies the welding as well as the examination of welds.

BRIEF DESCRIPTION OF THE DRAWINGS

In the drawings,

FIGS. 1, 2 and 3, for clarity only, disclose the truss work part in front of the center leg.

DETAILED DESCRIPTION OF THE PREFERRED EMBODIMENT

Figure 1:
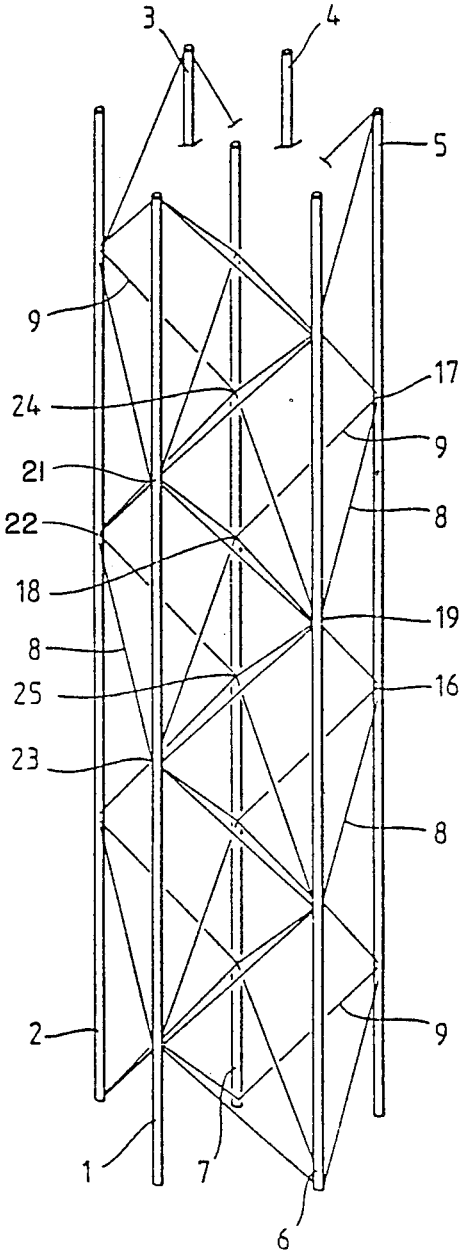
FIG. 1 discloses schematically a perspective part of a single hexagonal tower structure according to the invention.

The principal of the offshore truss work type tower structure according to the invention in its simplest embodiment is disclosed in FIG. 1 as a single hexagonal tower structure.

The tower structure of FIG. 1 comprises outer legs 1–6 and a center leg 7. A nodal point 19 on leg 6 and a nodal point 22 on leg 2, as well as a corresponding nodal point on leg 4, are arranged at the same level. From the nodal point 19 trusses 8 extend upward to nodal point 17 on leg 5 and nodal point 21 on leg 1 and downward to nodal point 16 on leg 5 and 23 on leg 1. Nodal points 16 and 23 as well as a third nodal point on leg 3 are arranged at the same level and between two levels for nodal points on leg 6.

In addition to trusses 8 and the two legs 5 and 6 for establishing the outer panels, trusses 9 extend from nodal point 19 upward to a nodal point 24 and downward to a nodal point 25 on the center leg 7. Nodal point 24 on the center leg 7 is arranged at the same level as the nodal points 17 and 21 on legs 5 and 1, respectively.

Figure 2:
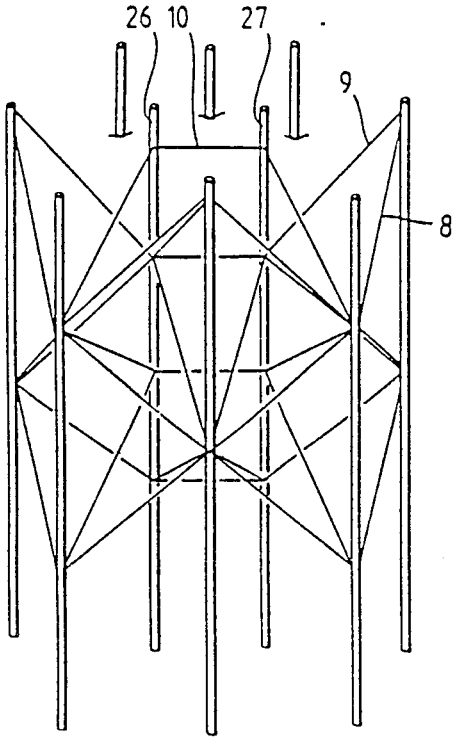
FIG. 2 discloses a double hexagonal tower structure.
Figure 3:
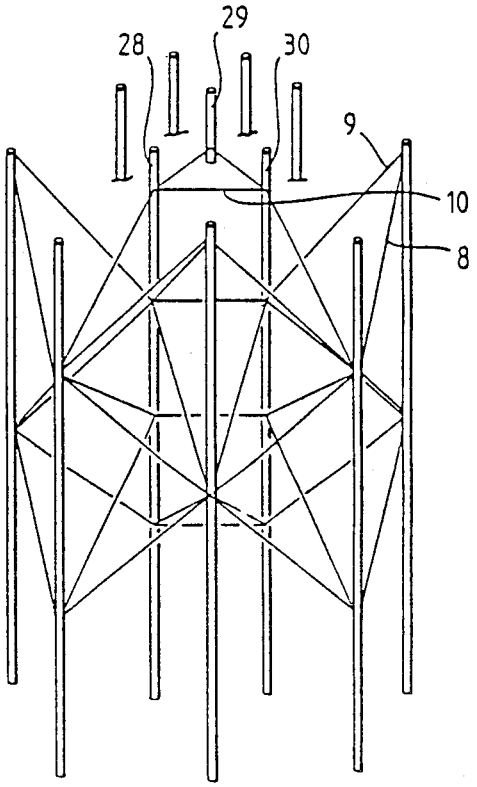
FIG. 3 discloses a triple hexagonal tower structure.

In the same manner the double hexagonal tower structure of FIG. 2 and the triple hexagonal tower structure of FIG. 3 are constructed. However, horizonal trusses 10 are arranged between the internal legs 26 and 27 at each nodal point in the double hexagonal tower structure as disclosed in FIG. 2 and between each nodal point on the internal legs 28, 29 and 30 in the triple hexagonal tower structure disclosed in FIG. 3.

Figure 4:
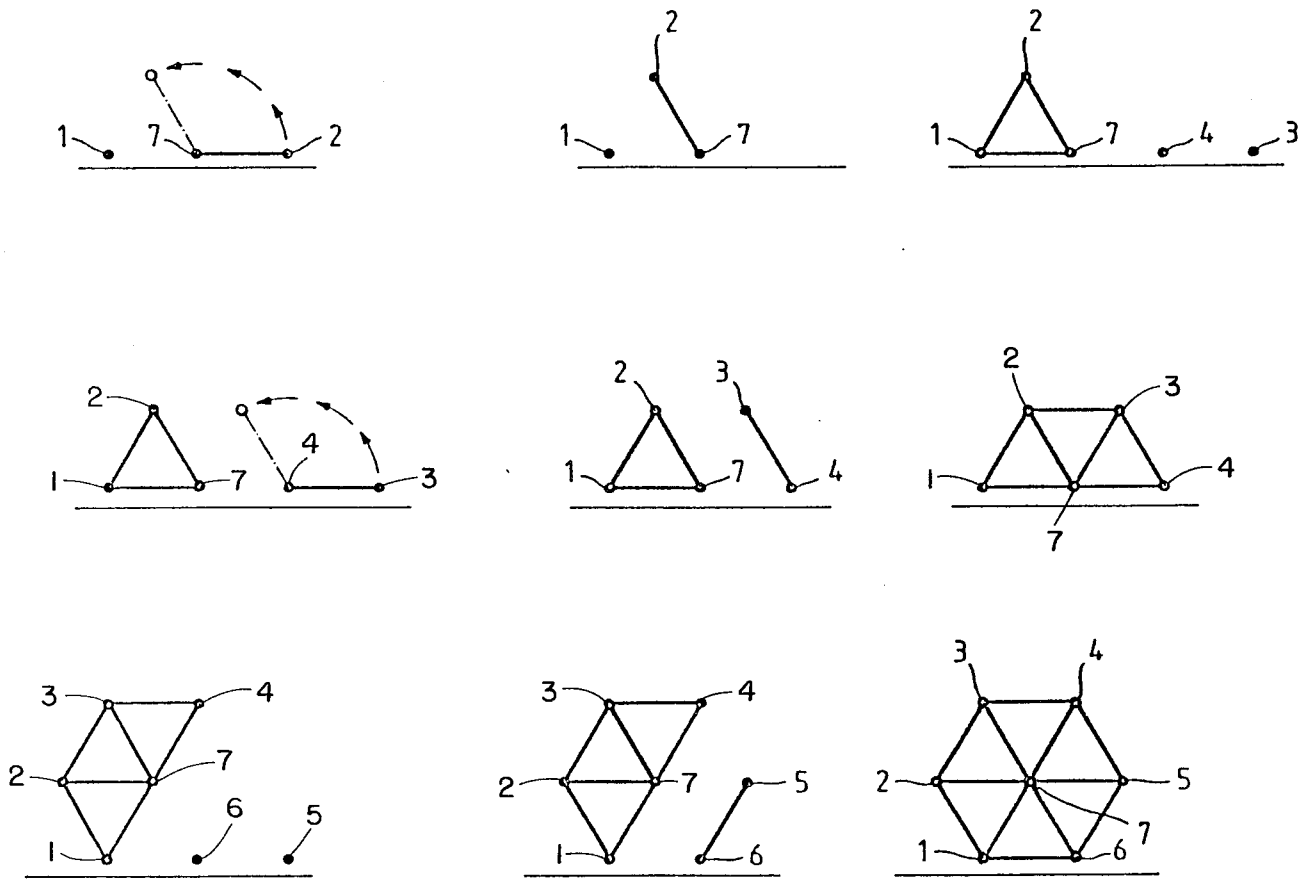

FIG. 4 discloses one method for constructing a single hexagonal tower structure where a radial panel between leg 2 and the center leg 7 first is constructed at the ground level and thereafter rotated around center leg 7 to a position where leg 7 and 2 are connected with leg 1 thereby providing a triangle shaped structure. Simultaneously an outer panel is constructed consisting of legs 3 and 4 with connecting trusses, which panel thereafter is rotated around leg 4 in such a way that trusses may be connected between outer legs 3 and 2 and between the outer legs 3, 4 and the center leg 7.

Thereafter the substructure consisting of legs 1–4 and 7 is lifted in position and an outer panel consisting of legs 5 and 6 with connecting trusses is constructed at ground level and thereafter rotated around leg 6. In this position trusses can be connected between legs 4 and 5 and between 1 and 6 as well as between the center leg and legs 5 and 6.

Figure 5:
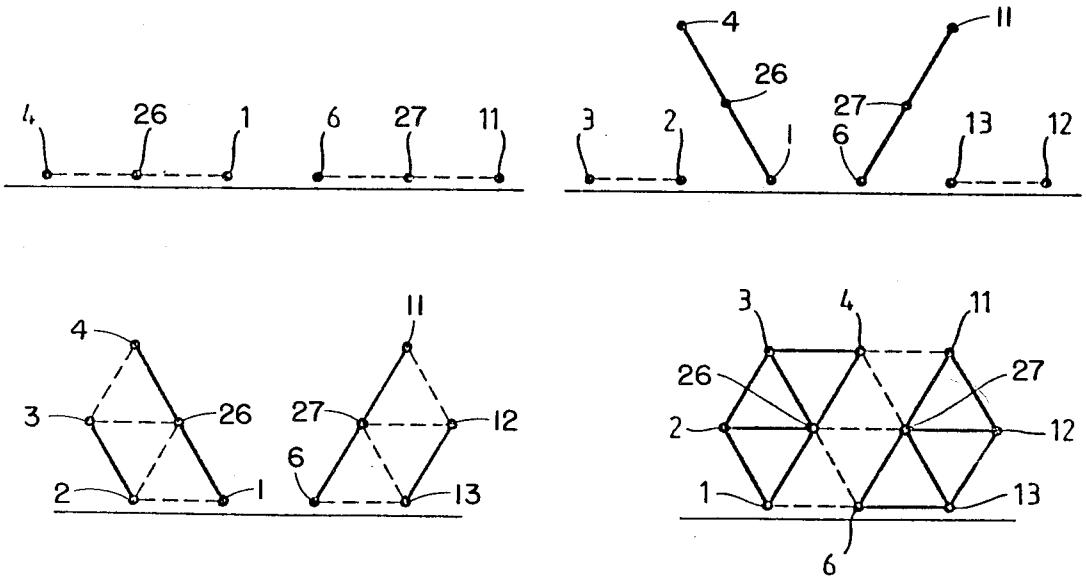

A double hexagonal tower structure may be constructed according to FIG. 5 by welding together outer legs 1 and 4 as well as internal leg 26 on the ground level and simultaneously constructing a panel comprising outer legs 6 and 11 and internal leg 27. Thereafter the panels are rotated around legs 1 and 6, and outer panels comprising legs 2 and 3, and 12 and 13 are constructed on the ground level, then rotated around legs 2 and 13. Trusses are then constructed between outer legs 3 and 4, and 2 and 1 as well as between 11 and 12 and 6 and 13. The internal trusses between center leg 26 and outer legs 2 and 3, and between center leg 27 and outer legs 12 and 13 are then constructed. Thereafter, the substructure consisting of outer legs 1–4 and internal leg 26 is rotated around leg 1 and trusses may be secured between legs 4 and 11, 1 and 6, 4 and 27, and 26 and 6, as well as the horizontal trusses 10 between the internal legs 26 and 27.

Figure 6:
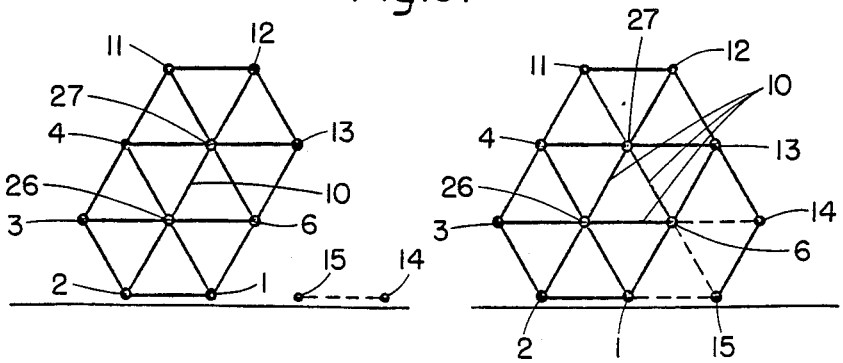
FIGS. 4, 5 and 6 disclose construction steps for a single, double and triple hexagonal tower structure, respectively.

In constructing a triple hexagonal tower structure, the completed double hexagonal tower structure disclosed in FIG. 5 can be rotated around leg 1 to the position disclosed in FIG. 6. An outer panel consisting of legs 14 and 15 is constructed at the ground level and thereafter rotated around leg 15, whereafter trusses may be secured between legs 13 and 14, 6 and 15, and 1 and 15. In the case of a triple hexagonal tower structure the internal legs 28, 29 and 30 shown in FIG. 3 correspond to the legs 26, 27, and 6 in FIG. 6, and are connected with horizontal trusses 10 when the structure is rotated to the position disclosed in FIG. 6.

We claim:

1. Offshore truss work type tower structure consisting of a plurality of outer legs and at least one internal leg, all legs being arranged vertical and parallel and interconnected by truss bracings joined with the legs at nodal points, comprising said truss bracings connected with outer legs being arranged diagonally to and at the same angle to each leg, all of said truss bracings extending between two legs having no further connections than with said two legs, each nodal point on an outer leg being arranged at a vertical level in the middle between two nodal point levels on adjacent legs, six truss bracings thereby being diagonally connected at each nodal point on outer legs consisting of two truss bracings from each adjacent leg and two from said internal leg, wherein said two truss bracings diagonally connected with said internal leg are of equal length.

2. Tower structure according to claim 1, wherein the tower structure has a uniform hexagonal cross section with one internal leg equidistant to said outer legs and extending the length of said tower.

3. Tower structure according to claim 1, having a uniform cross section which further comprises two partly overlapping hexagons, the internal leg of one hexagon thereby establishing an outer leg of the other hexagon and vice-versa to provide two internal legs, said internal leg being equidistant to said outer legs of said overlapped hexagon, and truss bracings between said two internal legs being arranged perpendicular to said internal legs at parallel levels.

4. Tower structure according to claim 1, having a uniform cross section which further comprises three partly overlapping hexagons, the internal leg of one hexagon thereby establishing one outer leg of the other two hexagons and vice-versa to provide three internal legs, and truss bracings between the three internal legs thereby being arranged perpendicular to said legs to form triangular braces at parallel levels.

5. An offshore truss work type tower according to claim 1, wherein the tower is constructed on-site, which is produced by the steps of:

constructing at ground level a first frame consisting of an outer leg and an internal leg connected by trusses;

rotating said first frame around the internal leg and connecting a second outer leg with said first outer leg and said internal leg by trusses;

constructing a second frame comprising third and fourth outer legs;

rotating said second frame around said fourth leg and connecting said second and third legs as well as said third leg and said fourth leg to said internal leg by trusses to form a substructure;

constructing a third frame comprising fifth and sixth outer legs; and rotating the substructure consisting of said first, second, third, fourth and internal legs around said first leg and connecting the substructure with said third frame by connecting said fourth and fifth legs, sixth and first legs, and fifth and sixth leg with the internal leg by trusses;

thereby completing a tower structure section having a uniform hexagonal cross section.

6. An offshore truss worktype tower according to claim 3, wherein the tower is constructed on-site, which is produced by the steps of:

constructing two double frames at ground level, wherein one double frame consists of first and second outer legs and one internal leg connected by trusses, and the other double panel consists of third and fourth outer legs and a second internal leg connected by trusses;

rotating said double frames around said first leg and said third leg, respectively;

constructing outer frames comprising fifth and sixth outer legs connected by trusses, and seventh and eighth outer legs connected by trusses;

rotating said outer frames around said fifth leg and eighth leg, respectively;

connecting each outer frame with its respective double frame by trusses to form two substructures;

rotating one of the substructures around said first leg to a position whereby the two double frames are parallel; and connecting the two substructures to each other by trusses, whereby the trusses between the internal legs are arranged perpendicularly to the legs at parallel levels;

a double hexagon tower structure hereby being completed having two hexagons partly overlapping.

7. An offshore truss work type tower according to claim 4, wherein the tower is constructed on-site, which is produced by the steps of:

rotating a double hexagon tower structure around said first leg to an up right position;

constructing a frame consisting of ninth and tenth outer legs; and connecting said frame to the double hexagon tower structure by trusses;

whereby the trusses connecting the internal legs are arranged perpendicularly to the legs, forming an internal triangular brace between said internal legs, a triple hexagon tower hereby being completed having three hexagons partly overlapping.

* * * * *